US008544439B2

(12) United States Patent
Desjardins

(10) Patent No.: US 8,544,439 B2
(45) Date of Patent: Oct. 1, 2013

(54) AIR INTAKE TRACT HAVING A FLEXIBLE SUMP

(75) Inventor: Michael Desjardins, Kalamazoo, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 282 days.

(21) Appl. No.: 13/165,355

(22) Filed: Jun. 21, 2011

(65) Prior Publication Data

US 2012/0325174 A1 Dec. 27, 2012

(51) Int. Cl.
*F02M 35/10* (2006.01)

(52) U.S. Cl.
USPC ..... 123/184.21; 180/68.3

(58) Field of Classification Search
USPC ..... 123/184.21; 180/68.3
See application file for complete search history.

(56) References Cited

FOREIGN PATENT DOCUMENTS

WO WO2008108396 A1 9/2008

*Primary Examiner* — Noah Kamen
(74) *Attorney, Agent, or Firm* — James Hasselbeck

(57) ABSTRACT

An engine air intake tract includes a flexible air intake duct having a flexible tubular body. A plurality of radially extending convolutes are formed in and spaced apart on an axially extending outer wall of the tubular body. Each convolute has a circumferential ring-shaped inwardly extending peak bordered by outwardly extending troughs. A liquid sump is formed into a lower portion of the tubular body and includes a plurality of spaced sump chambers with each chamber formed between and connected to at least two adjacent ones of the convolutes and extending radially outwardly from the convolutes.

6 Claims, 2 Drawing Sheets

AIR INTAKE TRACT HAVING A FLEXIBLE SUMP

TECHNICAL FIELD

The invention relates to the combustion air intake tract of an internal combustion engine in which the air intake tract is equipped with one or more flexible air ducts and at least one of the flexible ducts is equipped with a flexible sump.

BACKGROUND OF THE INVENTION

Operation of an internal combustion engine develops combustion byproduct gases. Combustion of a hydrocarbon fuel in air containing oxygen generally produces heat, water vapor, carbon dioxide, various carbon compounds (carbon monoxide for example) and nitrogen. A portion of these gaseous byproducts, also called "blow-by gases", may escape from the combustion chamber into the oil sump of the engine. Such blow-by gases, which typically also include oil mist or oil vapor may be returned to the engine air intake tract, sometimes through a crankcase ventilation valve (PCV valve) and piping connecting the vapor space above the engine oil sump into the air intake tract of the engine.

Releasing such blow-by gases to the environment is to be avoided as blow-by gases contain significant quantities of hydrocarbons as well as oil mist or oil vapors and are a significant source of air pollution.

However, returning water vapors and oil mist or oil vapors into the air intake tract is also problematic. As the heated combustion blow-by gases cool, liquid vapors in the blow-by gases may condense within the engine air intake tract duct. Also entrained oil mists may accumulate on the walls of the air intake tract.

Particularly problematic is when the accumulated liquids find their way in the air intake tract into the air filter element where they may contaminate, obstruct or saturate the air filter element, resulting in increased pressure drop across the air filter and critically reducing combustion air flow to the engine.

In some cases oils and liquids carried by blow-by gases may deposit onto the throttle valve and/or the mass air flow sensor (MAF). Oily deposits on the throttle valve may capture or entrain dust and dirt in the intake air that may result in sticking or erratic operation of the throttle valve. Oily deposits on the MAF sensor may contaminate the MAF sensor, for example a heated air flow sensing wire, thereby impeding its ability to provide an accurate air flow signal to the engine management system.

It is known to provide flexible air intake tract ducts such as blow-molded or injection molded ducts. Such flexible ducts are important as their flexibility permits the air intake duct to flex or bend as the engine moves and/or "rolls" relative to other body mounted components under the motor vehicle hood.

SUMMARY OF THE INVENTION

An objective of the invention is to provide an engine air intake tract having a flexible air intake duct in which is formed a liquid storage sump to store condensed liquids and oil mist that may be present in the air intake tract so that the removed/stored liquids are prevented from migrating in the air intake tract into other components such as the air filter element, the MAF or throttle valve, for example.

Another objective of the invention is to provide a flexible air intake duct and liquid storage sump that does not impede or limit the flexibility of the air intake duct. This is important so that the intake duct is free to flex under various engine load and roll conditions during operation of the motor vehicle.

Particularly advantageous types of air intake ducts have circumferentially arranged corrugations or convolutes formed into the wall of the duct. Such convolutes or corrugations are known to improve the flexibility of the air intake duct, thereby accommodating bending, flexure, extension and compression of the intake duct that may be required in service without over stressing the duct to failure.

According to at least one aspect of the invention, an engine air intake tract includes a flexible air intake duct having a flexible tubular body. A plurality of radially extending convolutes are formed in and spaced apart on and circumferentially arranged on an axially extending outer wall of the tubular body. When viewed from the interior of the duct, each convolute has a circumferential ring-shaped inwardly extending peak bordered by outwardly extending troughs. A liquid sump is formed in the outer walls and extends outwardly from the wall, the sump is formed into a lower portion of the tubular body and includes a plurality of spaced sump chambers with each chamber formed between and connected to at least two adjacent ones of said convolutes and extending radially outwardly from said convolutes.

According to another aspect of the invention, a flow vein is provided in the wall of the tubular body with the flow vein connected to and extending between adjacent sump chambers. The flow vein communicates stored fluid between the adjacent sump chambers.

According to another aspect of the invention, the flow vein is a channel-like depression formed into at least one of the ring-shaped inwardly extending peaks separating adjacent sump chambers.

According to another aspect of the invention, the air intake duct including the convolutes and sump with sump chambers is a unitary blow molded or injection molded plastic component.

According to another aspect of the invention, a crankcase vent conduit conducts crankcase blow-by gases from the internal combustion engine into the flexible air intake duct.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
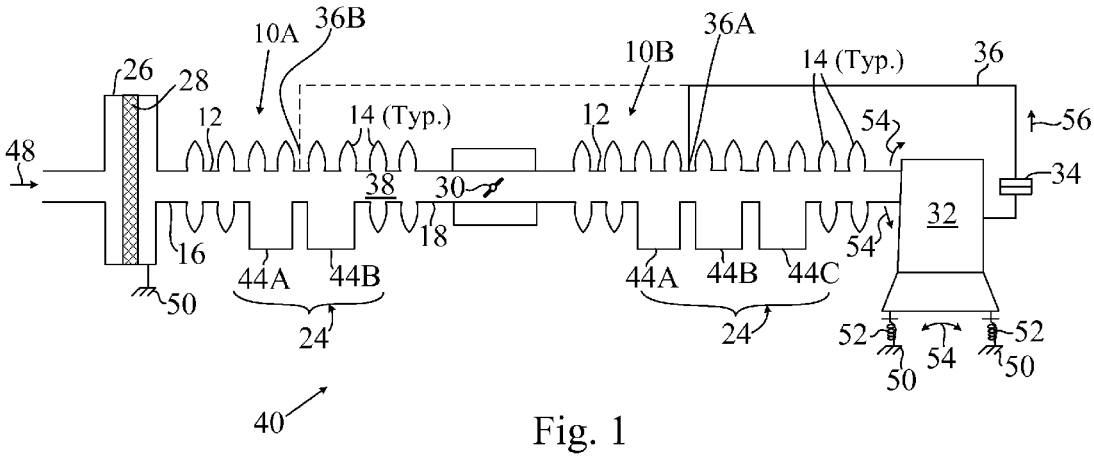
FIG. 1 is a schematic sectional view of an air intake tract of a motor vehicle, consistent with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to an air intake tract provided with a flexible air intake duct having a flexible liquid store sump. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 is a schematic sectional view of an air intake tract of a motor vehicle, consistent with the present invention. In FIG. 1, internal combustion engine 32 has a combustion air intake tract 40 drawing air flow (arrow 48) from the outside environment into the intake ports of the engine 32. The internal combustion engine 32 may be mounted to a motor vehicle chassis or frame 50 on somewhat elastic or displaceable engine mounts 52 with the result that the engine 32 is moveable and/or rotationally displaceable or able to angularly "roll" relative to the chassis or frame 50 as shown by arrows 54.

Combustion air 48 drawn into the air intake tract 40 is first filtered through an air filter element 28 which may be replaceablely or exchangeably installed into an air clean housing 26. As in known in the art, the air filter element is critical in removing particulate contaminants and debris which might otherwise damage the close tolerances between moving parts in the engine 32.

The air cleaner housing 26 may be fixedly mounted to the chassis or frame 50 while the engine 32 may move or roll 54 under changing load and torque conditions such that the air intake ducts (10A and/or 10B) may be required to bend, or axially extend or compress in length as a result of engine roll 54.

As discussed earlier above, normal operation of internal combustion engine 32 may generate hydrocarbon laden blow-by gases 56 which, for reasons discussed earlier, are typically returned to the engine air intake tract 40 sometimes through a crankcase ventilation valve (PCV valve) 34 and crankcase vent conduit 36 connecting the vapor space above the engine oil sump into the air intake tract 40 of the engine 32.

A throttle valve 30 may be arranged in the air intake tract 40 at a location between the air filter element 28 and the engine 32. The throttle valve 30 may be fixedly mounted to the engine 32 to roll with the engine 32, or alternately, for example, mounted to the chassis or frame 50. The crankcase vent conduit 36 may be connected to the intake tract either after the throttle valve 30 (connection 36A) or before the throttle valve 30 (connection 36B, shown as a dashed line). Preferably crankcase vent conduit connection to the air intake tract is arranged after (or downstream) the throttle valve such that the throttle valve is not normally exposed to blow-by gases during engine operation. According to the present invention, the air intake tract 40 includes one or more flexible air intake ducts, for example, either flexible air intake ducts 10A or 10B or both. The crankcase vent conduit 36 may be configured to recycle blow-by gases to the air intake tract into flexible air intake duct 10B or flexible air intake duct 10A.

The flexible air intake duct (10A or 10B) is preferably a one-piece unitary component made of a moldable plastic material by a blow molding or injection molding process.

The flexible air intake duct (10A or 10B) has a flexible tubular body 12 surrounding an air flow passage 38 extending between the air inlet end 16 and the air outlet end 18 of the flexible tubular body 12.

The outer wall of the tubular body 12 of the flexible air duct (10A or 10B) includes a plurality of radially extending convolutes 14, the convolutes 14 axially spaces apart along the axial length of the outer wall of the flexible tubular body12. The convolutes 14 acting to provide flexibility to the tubular body 12 enabling the flexible air intake duct (10A or 10B) to be freely bent to conform to available space and installation requirements under the hood of the vehicle. Additionally the convolutes 14 in the outer wall of the tubular body 12 configure the flexible air duct (10A or 10B) to be freely bent, axially expanded or collapsed by a sufficient amount to allow for engine movement and/or engine roll 54 introduced by changes in engine load.

To capture and store liquids and oil mist that may condense from the air flow in the air flow passage 38, the flexible air intake duct (10A or 10B) preferably includes a liquid sump 24 formed as a recess, depression or chamber into a lower portion of the flexible air intake duct (10A or 10B) and positioned to capture and hold liquids therein.

According to the present invention, the liquid sump is formed by a plurality of liquid receiving chambers (for example 44A, 44B, 44C) that are spaced apart along a lower portion of the outer wall of the flexible tubular body 12. According to the invention, two or more liquid receiving chambers may be provided with the chosen number of liquid chambers being sufficient to provide the required sump storage volume for the application. The axially spaced liquid receiving chambers (for example 44A, 44B, 44C) are formed in the outer wall of the tubular body 12 as extensions of the convolutes 14 permitting the flexible air duct (10A or 10B) to be freely bent, axially expanded or collapsed by a sufficient amount to allow for engine movement and/or engine roll 54.

Figure 2:
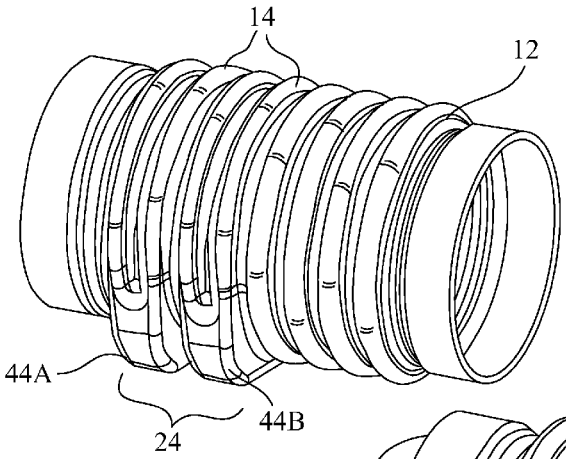
FIG. 2 is side perspective view of one exemplary embodiment of a flexible air intake duct provided with a flexible sump, consistent with the present invention.
Figure 3:
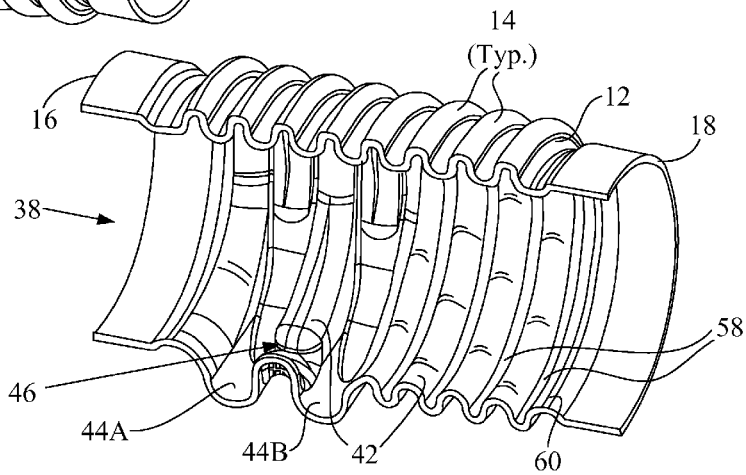
FIG. 3 is a side sectional view of the flexible air intake duct embodiment of FIG. 2, consistent with the present invention.

For further enablement and to support discussion of the inventive concepts, an example or exemplary embodiment of the flexible air intake duct (10A or 10B) of the invention is provided in FIG. 2 and FIG. 3. FIG. 2 is side perspective view of one exemplary embodiments of a flexible air intake duct provided with a flexible sump, consistent with the present invention. FIG. 3 is a side sectional view of the flexible air intake duct embodiment of FIG. 2, consistent with the present invention.

FIG. 2 depicts a perspective view of the outer wall of the flexible tubular body 12 of the flexible air intake duct (10A or 10B), showing the plurality of radially extending convolutes 14 formed in the outer wall and axially spaced along the other wall. Also shown is a liquid sump 24 formed into the lower portion of the flexible tubular body 12 and having (in this example) two liquid receiving chambers (44A and 44B) that are axially spaced apart and generally integrated with the convolutes so as to permit the flexible tubular body 12 to bend, compress or elongate between the liquid receiving chambers 44A and 44B. Implementing the sump 24 as a plurality of liquid receiving chambers (44A and 44B) advantageously retains the flexibility of the flexible tubular body 12 over the portion of the body having the sump 24, permitting even the portion of the tubular body 12 between the liquid chambers (44A, 44B) to bend, compress or elongate as needed.

FIG. 3 is a side sectional view of FIG. 2 showing internal features of the flexible air intake duct (10A or 10B) including the liquid sump 24 and radially extending convolutes 14 of FIGS. 2 and 1. As can be best seen in FIG. 3, the flexible air intake duct (10A or 10B) includes an air flow passage 38 extending between the air inlet end 16 and air outlet end 18 of the flexible tubular body 12. The convolutes 14 are formed in the outer wall of the tubular body 12 and are spaced apart axially along the outer wall of the tubular body 12. The convolutes 14 form radially outwardly extending circumferential ring-shaped troughs in the inner wall 60 of the tubular body 12 spaced apart by at least one inwardly extending peak 42 acting to delimit or divide the ring-shaped troughs 58 with the inwardly extending peaks forming walls of the troughs 58.

In FIG. 3, (as in FIG. 2) the liquid sump 24 is formed into the lower portion of the flexible tubular body 12 and includes (in this example) two liquid receiving chambers (44A and 44B) that are axially spaced apart and generally integrated with the convolutes 14 so as to permit the flexible tubular body 12 to bend, compress or elongate between the liquid receiving chambers 44A and 44B.

As can be seen in FIG. 3, the liquid receiving chambers (44A and 44B) may each extend across multiple convolutes 14 and are separated from each other by at least one inwardly extending peak 42 positioned therebetween.

As shown in FIG. 3, a flow vein 46 may be provided. The flow vein 46 is formed in the inside surface of the outer wall of the tubular body 12 and fluidically interconnects the liquid receiving chambers 44A and 44B, permitting stored fluid to flow between the liquid receiving chambers 44A and 44B.

Advantageously, the present invention permits the inclusion of a flexible liquid sump 24 in the flexible air intake duct where the sump is operative to collect and store fluids while still maintaining the flexibility of the air intake duct (10A or 10B) and permitting the air intake duct to be bent or shaped to fit installation space constraints, for example, under the hood of a motor vehicle.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. An air intake tract delivering combustion air to an internal combustion engine, said air intake tract comprising:
- an internal combustion engine receiving airflow from and in airflow communication with said air intake tract;
- an air filter element arranged in said air intake tract upstream of said engine, said air filter element filtering said combustion air;
- an air intake duct connected to and forming a portion of said air intake tract, said air intake duct having an air flow passage extending axially therethrough connecting an air inlet end receiving air flow from said filter element and an air outlet end delivering airflow to said internal combustion engine, said air intake duct including:
  - a flexible tubular body;
  - a plurality of radially extending convolutes formed circumferentially on an axially extending outer wall of said tubular body, said convolutes spaced apart axially on said outer wall, said convolutes forming circumferential ring-shaped inwardly extending peaks and outwardly extending troughs in said outer wall,
  - wherein said plurality of convolutes provide flexibility to said tubular body;
  - a liquid sump formed into a lower portion of said flexible tubular body, said sump including
    - a plurality of sump chambers,
      - each sump chamber formed between and connected to at least two adjacent ones of said convolutes;
      - each sump chamber extending radially outwardly from said outer wall;
    - wherein adjacent ones of said sump chambers are separated on said outer wall by at least one of said ring-shaped inwardly extending peaks,
    - wherein adjacent ones of said sump chambers are spaced apart from each other,
    - wherein said air intake duct is flexibly bendable between said adjacent ones of said sump chambers, and
  - wherein said liquid sump stores liquids removed from said airflow.

2. The air intake tract according to claim 1, further comprising a flow vein extending between and fluidically interconnecting adjacent ones of said sump chambers, said flow vein communicating stored fluid between said adjacent ones of said sump chambers.

3. The air intake tract according to claim 2, wherein said flow vein is a channel-like depression formed into said at least one of said ring-shaped inwardly extending peaks separating said adjacent ones of said sump chambers.

4. The air intake tract according to claim 1, wherein said air intake duct including said sump chambers and convolutes is a unitary blow molded or injection molded plastic component.

5. The air intake tract according to claim 1, further comprising a crankcase vent conduit connection on said flexible air duct, said connection conducting crankcase blow-by gases from said internal combustion engine into said flexible air intake duct.

6. The air intake tract according to claim 1, wherein said plurality of sump chambers extend radially outwardly from said outer wall beyond said outwardly extending troughs of said plurality of radially extending convolutes.

* * * * *